United States Patent [19]

Kopatz et al.

[11] Patent Number: 4,743,297

[45] Date of Patent: May 10, 1988

[54] PROCESS FOR PRODUCING METAL FLAKES

[75] Inventors: Nelson E. Kopatz, Sayre; Jack E. Vanderpool, Laceyville, both of Pa.; Philip E. Stermer, Waverly, N.Y.; Howard H. Shaw, Monroeton, Pa.

[73] Assignee: GTE Products Corporation, Stamford, Conn.

[21] Appl. No.: 33,708

[22] Filed: Apr. 3, 1987

[51] Int. Cl.[4] ..... B22F 9/04

[52] U.S. Cl. ..... 75/0.5 B; 75/0.5 BA; 75/0.5 BB; 75/0.5 BC

[58] Field of Search ..... 75/0.5 B, 0.5 BA, 0.5 BB, 75/0.5 BC, 0.5 C

[56] References Cited

U.S. PATENT DOCUMENTS 3,151,971 10/1964 Clough ..... 75/0.5 B 3,165,396 1/1965 Goon ..... 75/0.5 B

*Primary Examiner*—Wayland Stallard

*Attorney, Agent, or Firm*—Donald R. Castle; L. Rita Quatrini

[57] ABSTRACT

A process is disclosed for producing metal flakes. The process involves entraining the metal powder particles in a carrier gas and passing the powder particles through a high temperature zone at a temperature above the melting point of the powder particles to melt at least about 50% of the powder particles, resolidifying the resulting high temperature treated material by impacting the material against a substrate, and thereafter contacting the material with a non-oxidizing gas which can be nitrogen, argon, hydrogen, helium or combinations of these to remove the material from the substrate in the form of flakes.

6 Claims, 2 Drawing Sheets

PROCESS FOR PRODUCING METAL FLAKES

This invention relates to a process for producing metal flakes by impacting high temperature treated material against a substrate and thereafter removing the material from the substrate in the form of flakes. More particularly, the high temperature treatment is a plasma process.

BACKGROUND OF THE INVENTION

Metal flakes, in particular those made by rapid solidification are useful in applications such as pigments, electromagnetic shielding, and powder metallurgical applications.

Up to this time, metal flakes have been made by breaking down foils made by melt spinning or melt extraction processes. The material must be further processed to produce flakes.

It would be advantageous to produce flakes directly from starting material without having to go through extra or separate processing to produce flakes.

The process of the present invention produces flakes directly from the starting material without extra or separate processing steps.

SUMMARY OF THE INVENTION

In accordance with one aspect of this invention, there is provided a process for producing metal flakes. The process involves entraining metal powder particles in a carrier gas and passing the powder particles through a high temperature zone at a temperature above the melting point of the powder particles to melt at least about 50% by weight of the powder particles, resolidifying the resulting high temperature treated material by impacting the material against a substrate, and thereafter contacting the material with a non oxidizing gas which can be nitrogen, argon, hydrogen, helium, and combinations of these to remove the material from the substrate in the form of flakes.

DETAILED DESCRIPTION OF THE INVENTION

Figure 1:
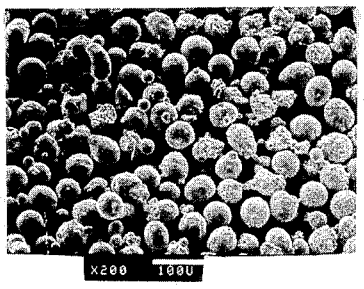
FIG. 1 is an SEM photograph of a stainless steel starting powder of this invention. (200x magnification).

For a better understanding of the present invention, together with other and further objects, advantages and capabilities thereof, reference is made to the following disclosure and appended claims in connection with the above described figures and description of some of the aspects of the invention.

The starting material of this invention can be essentially any type of metal powder particles such as agglomerated, atomized, elemental, alloy, or pre-alloyed powders. The powders can be crushed or irregular. Examples of metal powders that are especially suited to the process of this invention are stainless steel, tungsten heavy metal alloys such as tungsten alloys with iron and nickel, alloys of iron-neodinium-boron, and copper metal.

The size of the starting powder particles is preferably from about 20 to about 200 and preferably from about 40 to about 100 micrometers in diameter. The particle size measurement is done by conventional sieve analysis.

If necessary, the starting powders are exposed to high temperatures and controlled environment to remove carbon and oxygen, etc.

The powders are entrained in a carrier gas such as argon and passed through a high temperature zone at a temperature above the melting point of the powders for a sufficient time to melt at least about 50% by weight of the powders. The preferred high temperature zone is a plasma.

Details of the principles and operation of plasma reactors are well known. The plasma has a high temperature zone, but in cross section the temperature can vary typically from about 5500° C. to about 17,000° C. The outer edges are at low temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

As the material passes through the plasma and cools, it is rapidly solidified. According to this invention, the solidification is accomplished by impacting the high temperature treated or molten material against a substrate and thereafter contacting the material with a non-oxidizing gas to remove the material from the substrate in the form of flakes. The non-oxidizing gas can be nitrogen, argon, hydrogen, helium, and combination of these. Hydrogen and helium are preferred because they result in the most efficient recovery of the flakes from the substrate.

The nature of the substrate can vary with the type of metal flake which is to be produced. But generally, the substrates are pyrolitic graphite, pyrolitic boron nitride, or molybdenum which is preferably polished molybdenum.

Particle shape and/or size is altered by impacting the molten particles against a substrate and causing them to deform.

In accordance with a preferred embodiment of this invention, the resolidification is accomplished by impacting the molten material against a substrate which is a rapidly spinning, cooled pyrolitic graphite disc. Typically the substrate is cooled by liquid nitrogen. With this type of substrate it is especially preferred to have a flow of gas which is preferably either hydrogen or helium, having a high pressure, for example, from about 50 to about 300 psi or higher, impinged on the active surface of the substrate at a point immediately after the molten particles impinge on it. This causes rapid solidification and release of flakes. The flakes are formed from each individual molten particle. One preferred material that is made into flakes by this preferred method is stainless steel.

The size of the flakes is from about 1 to about 10 and typically less than about 5, and most typically from about 1 to 5 micrometers in thickness. The diameter is from about 30 to 500 micrometers and most typically from about 100 to about 300 micrometers. The diameter is measured at the widest part of the flake. Measurements are done typically by optical methods.

The following table gives some of the most typical diameters at typical thicknesses.

TABLE OF FLAKE DIAMETERS AT GIVEN THICKNESSES

| Starting material (Non-flake) Diameter in micrometers | Flake Thicknesses Micrometers 1 | 2 | 5 | 10 |
|---|---|---|---|---|
| | Diameter of flakes at given thicknesses | | | |
| 40 | 103 | 73 | 46 | 32 |
| 80 | 292 | 206 | 130 | 92 |
| 100 | 408 | 288 | 182 | 129 |

As an example of the data in the Table, if a starting material has a diameter of 40 micrometers and a flake forms which is 1 micrometer thick, the diameter will be 103 micrometers.

After cooling and resolidification, the resulting high temperature treated material can be classified by screening to remove the out of size or shape material and obtain the desired size flakes and to remove the excessively fine material such as that which is equivalent to the starting size. The unmelted minor portion can then be reprocessed according to the invention to convert it to flakes.

By prior methods such as melt spinning, flakes are produced by crushing processed material. The process of this invention, is a one step conversion to flakes. The flake material produced by the process of this invention can be used as is in the application and does not have to be further processed as by crushing.

To more fully illustrate this invention, the following non-limiting example is presented.

EXAMPLE

Figure 2:
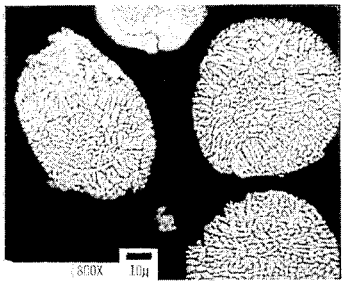
FIG. 2 is a light micrograph of a cross section of the particles of the above described material showing their microstructure. (800x magnification).
Figure 3:
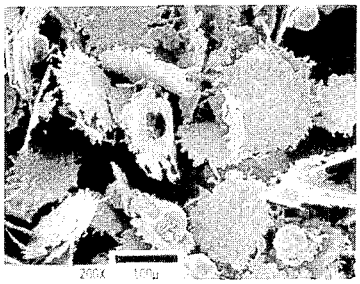
FIG. 3 is an SEM photograph of stainless steel flakes produced by the process of this invention. (200x magnification).
Figure 4:
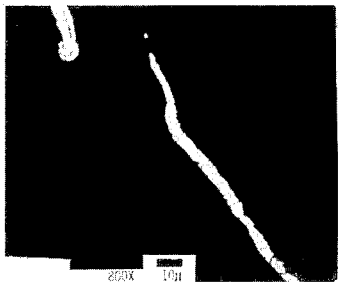
FIG. 4 is a light micrograph of a cross section of the above described flakes showing their microstructure. (800x magnification).

An argon-hydrogen-helium plasma flame is generated with a gas flow of about 20 l/min. Ar, about 2 l/min. $H_2$, about 30 l/min. He with about 22.5 KW of input power of about 450 amps and about 50 volts. Stainless steel starting powder shown in FIGS. 1 and 2, having a particle size of about 40 micrometers in diameter is introduced into the plasma flame at a rate of about 75 g/min. being fed by a carrier gas at a flow rate of about 3 l/min. The flow rate of the carrier gas can be typically from about 1 to about 10 l/min. The powder is melted in flight in the plasma and impinged on a rapidly spinning (about 2,000 to 10,000 rpm) pyrolitic boron nitride disc being cooled by liquid nitrogen and located about 6" below the nozzle. High pressure helium (250 PSIG) is directed via a nozzle at the substrate at a location near the spot where the particles are impinging on the substrate. Flakes are released from the substrate. FIGS. 3 and 4 respectively show the flakes and their microstructure.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing metal flakes, said process comprising:

(a) entraining metal powder particles in a carrier gas and passing said powder particles through a high temperature zone at a temperature above the melting point of said powder particles to melt at least about 50% by weight of said powder particles; and (b) resolidifying the resulting high temperature treated material by impacting said material against a substrate and thereafter contacting said material with a non-oxidizing gas selected from the group consisting of nitrogen, argon, hydrogen, helium, and combinations thereof, to remove said material from said substrate in the form of flakes.

2. A process of claim 1 wherein said metal powder particles are agglomerated prior to being entrained in said carrier gas and being passed through said high temperature zone.

3. A process of claim 1 wherein said high temperature zone is a plasma.

4. A process of claim 1 wherein said resolidification is accomplished by impacting said high temperature treated material against a substrate made of material selected from the group consisting of a pyrolitic graphite, pyrolitic boron nitride, and molybdenum.

5. A process of claim 4 wherein said powder is selected from the group consisting of tungsten heavy metal alloys, iron-neodinium-boron alloys, stainless steel, and copper.

6. A process of claim 1 wherein after said resolidification, said high temperature treated material is classified to obtain the desired particle size of flakes.

* * * * *